United States Patent [19]

Kato et al.

[11] Patent Number: 4,660,718

[45] Date of Patent: Apr. 28, 1987

[54] FASTENER ASSEMBLY

[75] Inventors: Masami Kato, Nagoya; Hideyuki Ueno, Yokohama, both of Japan

[73] Assignee: Toska Co., Ltd., Chiyoda, Japan

[21] Appl. No.: 726,478

[22] Filed: Apr. 24, 1985

[30] Foreign Application Priority Data

May 4, 1984 [JP] Japan ..... 59-88431

[51] Int. Cl.[4] ..... B65D 85/24; G09F 3/12

[52] U.S. Cl. ..... 206/343; 24/150 FP; 40/20 R; 206/380; 206/820

[58] Field of Search ..... 206/343, 346, 380, 820; 40/20 R, 24; 24/150 FP

[56] References Cited

U.S. PATENT DOCUMENTS

| | | | |
|---|---|---|---|
| 2,825,162 | 3/1958 | Flood | 40/20 R |
| 3,273,705 | 9/1966 | Rieger et al. | 206/343 |
| 3,492,907 | 2/1970 | Hauck | 206/343 |
| 3,532,212 | 10/1970 | Gatton | 206/343 |
| 3,645,164 | 2/1972 | Wurth | 206/343 |
| 3,733,657 | 5/1973 | Lankton | 206/343 |
| 4,333,566 | 6/1982 | Holmes | 206/343 |
| 4,417,656 | 11/1983 | Kato | 206/343 |
| 4,456,123 | 6/1984 | Russell | 206/343 |
| 4,534,464 | 12/1985 | Lankton | 206/343 |

FOREIGN PATENT DOCUMENTS

| | | | |
|---|---|---|---|
| 1478829 | 2/1969 | Fed. Rep. of Germany | 206/346 |

*Primary Examiner*—William Price
*Assistant Examiner*—Jimmy G. Foster
*Attorney, Agent, or Firm*—Burton, Parker & Schramm

[57] ABSTRACT

Disclosed is a fastener assembly comprising a number of fasteners each comprising a head, a crossbar and a filament interconnecting the head and the crossbar, each adjacent crossbars being interconnected through a connecting element in a manner of not undergoing a change in their relative positions, the number of crossbars in the fastener assembly being arranged in the form of a sheet as a whole.

13 Claims, 19 Drawing Figures

FASTENER ASSEMBLY

BACKGROUND

The present invention relates to fasteners molded from a synthetic resin in the form of a one-body assembly and, in use, individually successively severed and dispensed for anchoring tags or labels to various consumer goods such as clothing for example or for altogether bundling a plurality of articles.

As early as in 1963, U.S. Pat. No. 3,103,666 disclosed a first example of fastener assemblies of the sort mentioned, and since then, there has been proposed and put for an actual use a number of modified or improved fastener assemblies, including the one disclosed in U.S. Pat. No. 3,733,657.

Plastic-made fasteners in reference are normally of such a small size as to be about 30 to 50 mm in length that if they are individually separately produced from the outset, their handling is greatly inconvenienced, so that they are manufactured in groups or assemblies, each in most cases comprising 30 to 50 fasteners or, in some other cases, 75 to 100 fasteners.

Thus, in the above referred-to U.S. Pat. No. 3,733,657 for example, a fastener assembly is provided, which has a structure as illustrated in FIG. 1 of the accompanying drawings: As shown, each fastener of the assembly comprises a head 1, a filament 2 connected at its one end to a central portion of a side end face of the head 1, and a crossbar 3 formed at the other end of the filament 2 and extending in a plane parallel to the plane in which the head 1 extends, and a plurality of such individual fasteners are altogether connected to their common connecting rod 21 through their respective connecting necks 20. In this fastener assembly, further, heads 1 of each adjacent fasteners are connected to each other through a joint member 22 capable of being easily cut so that otherwise likely tangling of a first fastener assembly and a second one can be prevented from occurring.

The connecting necks 20 are not only necessary for connecting individual fasteners to the connecting rod 21 but also functional as means to be engaged by a feeding member of a fastener dispensing machine when the fasteners of a fastener assembly loaded in the dispensing machine are individually successively delivered to the prescribed shooting position within the dispensing machine.

Then, the connecting rod 21 serves the function of, so to speak, a backbone on which to support a plurality of fasteners in an arrangement resembling the one in which teeth are formed in a comb. Besides, it is indispensable in that in the molding of a fastener assembly, it is formed as a matter of course in a mold channel through which a molten synthetic resin is supplied.

Thus, conventional fastener assemblies typically represented by the one disclosed in the above considered U.S. Pat. No. 3,733,657 indispensably have connecting necks and connecting rods. However, even although these are conventionally indispensable to the formation of a fastener assembly, the connecting necks and connecting rod are not indispensable constituents of fasteners per se, and in addition, they involve various disadvantages such as follows.

With an example of the fastener assembly made of nylon, having 35 member fasteners formed on a connecting rod through their respective connecting necks and weighing 98 g, the weight of the connecting rod and connecting necks amounts to 10.5 to 14.5 g, which equal to about 11 to about 15% of the total weight of the fastener assembly. To be particularly noted in this connection is that when fasteners are dispensed in attaching tags or labels to merchandise, the connecting necks and connecting rod are no longer of utility and are simply discarded as waste. Therefore, from an economical point of view, it is advantageous to provide a fastener assembly having no connecting necks, nor a connecting rod.

Also, with reference to FIG. 2 of the accompanying drawings, as more fasteners are dispensed by a fastener dispensing machine 23, the connecting rod 21 is increasingly projected downwardly through a guide groove provided in the fastener dispensing machine for therein receiving fastener assemblies one at a time, and on the projected portion of the connecting rod 21 there are projected a number of connecting necks 20 from which individual fasteners have been detached by cutting by a cutter blade mounted in the fastener dispensing machine. Those projecting connecting necks 20 on the connecting rod 21 have an acute tip end produced by cutting by the cutter blade, and when they catch at merchandise, particularly fabric-made goods for example, they are likely to damage the merchandise, therefore a great care should necessarily be taken in performing the fastener dispensing operation or it should necessarily be operated to cut away the connecting rod 21 frequently before it has not projected a great length through the guide groove.

Then, there has been an attempt made to connect each adjacent crossbars 3 and 3 at a point along the length thereof so as to obtain a fastener assembly with which the disadvantageous connecting necks and connecting rod are effectively disposed of. With the fastener assembly then produced, however, although the above indicated disadvantages due to the connecting necks and connecting rod can be effectively cancelled, a new difficulty ispresented such that since adjacent crossbars are joined together only at a point or, more specifically at a central point along the length thereof, they cannot maintain a constant relative position or they are allowed, during a normal handling of the fastener assembly, to undergo pivotal motion with the point of their joint as the center of the motion, resulting in that their joint becomes broken. Once the connection between adjacent crossbars is broken, member fasteners of the fastener assembly, having no connecting necks nor a connecting rod and connected altogether only through their crossbars, become individually severed, whereby it no longer is feasible to load the fastener assembly in a fastener dispensing machine and eventually the individually severed fasteners have to be discarded as waste.

Also with the fastener assembly in which member fasteners are altogether connected only through their crossbars, it is likely that when a portion of the fastener assembly is permitted to catch at an item of merchandise during shooting operation of fasteners by a fastener dispensing machine, the connection between crossbars 3 and 3 becomes unintentionally broken.

SUMMARY

Accordingly, it is a first object of the present invention to provide a fastener assembly which does not include connecting necks and a connecting rod present in conventional fastener assemblies.

A second object of the invention is to provide a fastener assembly which can be produced without a wasteful consumption of a synthetic resin in that it is devoid of a connecting rod and connecting necks which are eventually discarded as waste.

A third object of the invention is to provide a fastener assembly in which crossbars of each adjacent member fasteners are connected to each other in a manner capable of stably maintaining their relative positions and at a strength of connection which can be easily overcome in shooting individual fasteners by a fastener dispensing machine.

A fourth object of the invention is to provide a fastener assembly which is less likely to cause a damage to merchandisc relative to which the fasteners are dispensed than conventional fastener assemblies having a connecting rod and connecting necks which, during the fastener dispensing operation, become protruded out of the fastener dispensing machine and are likely to catch at merchandise.

A fifth object of the invention is to provide a fastener assembly in which a number of member fasteners are closely or densely arranged in a row without a connecting rod and connecting necks which are likely to obstruct the handling and the fastener dispensing operation and are to be eventually discarded as waste, and which has such a compact arrangement of member fasteners that transportation and handling of fastener assemblies can be greatly facilitated.

A sixth object of the invention is to provide a fastener assembly which can be manufactured at a remarkable production efficiency.

THE DRAWINGS

Figure 12:
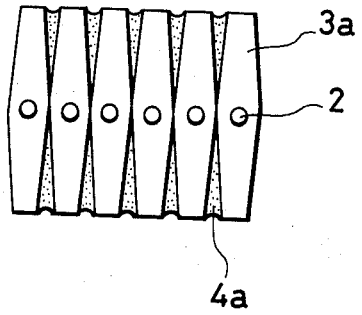
FIG. 12 is a top plan, showing the manner of interconnection of crossbars according to a second embodiment of the invention.
Figure 14:
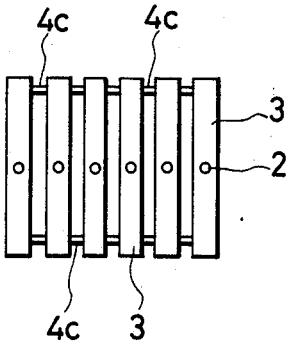
Figure 15:
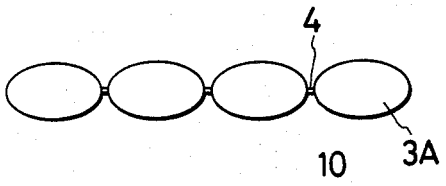
Figure 16:
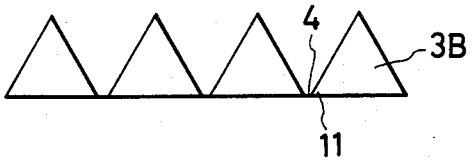
Figure 17:
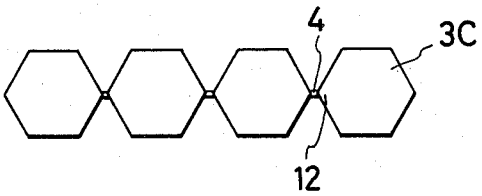
Figure 18:
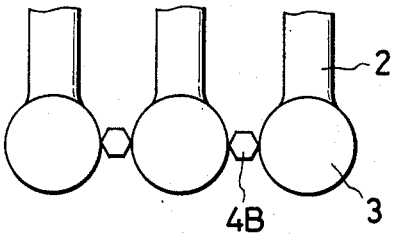
Figure 19:
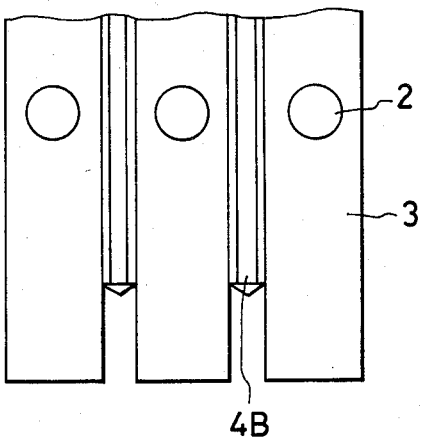

FIG. 14 also is a top plan similar to FIG. 12 and represents a fourth embodiment of the invention;

FIGS. 15, 16 and 17 altogether represent a fifth embodiment of the invention and respectively show a sectional view of crossbars; and FIGS. 18 and 19 are respectively a front view and a top plan, showing the manner of interconnection of crossbars according to a sixth embodiment of the invention.

THE PREFERRED EMBODIMENTS

Figure 1:
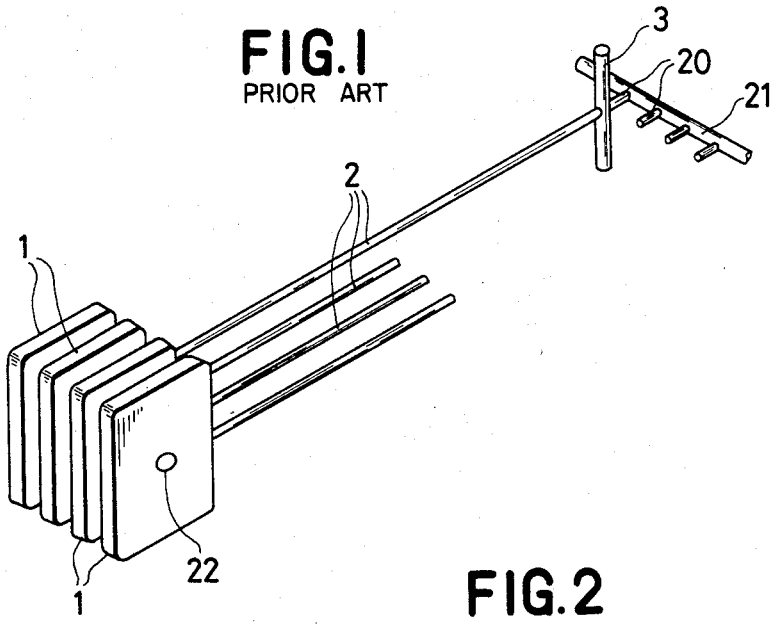
FIG.1 PRIOR ART
FIG. 1 shows a perspective view of a portion of a conventional fastener assembly.
Figure 2:
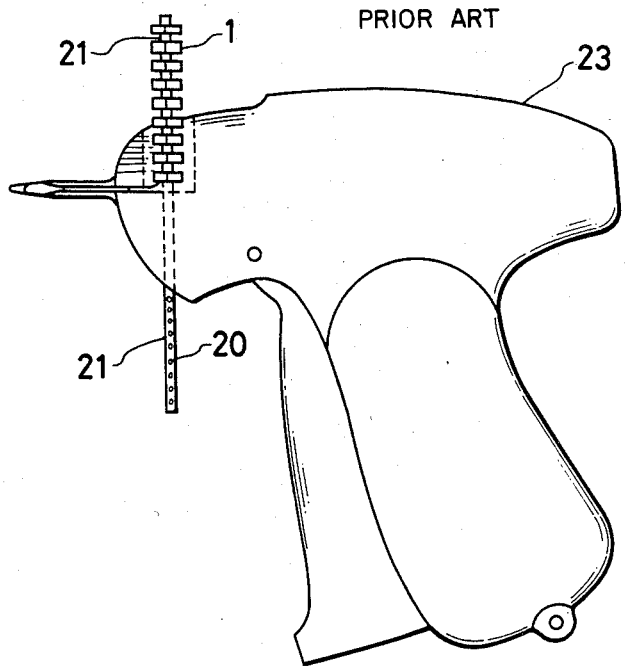
FIG.2 PRIOR ART
FIG. 2 is a view, taken for illustration of the operation condition in which the conventional fastener assembly of FIG. 1 is loaded in a fastener dispensing machine and a fastener dispensing or shooting operation is being carried out.
Figure 3:
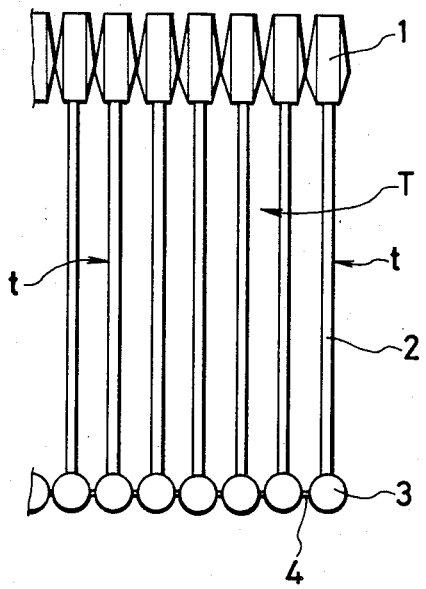
FIG. 3 is a front elevation of a fastener assembly according to a first embodiment of the present invention.
Figure 4:
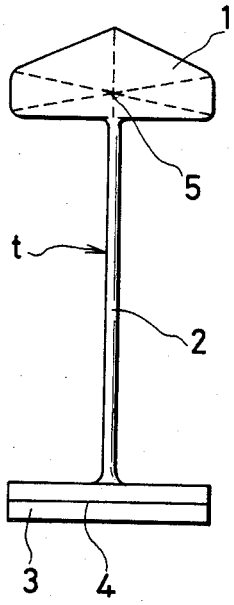
FIG. 4 is a side elevation of FIG. 3.

The fastener assembly indicated at T in FIGS. 3 and 4 which represent a first embodiment of the present invention is molded as an integral device from a synthetic resin and comprises a plurality of individual fasteners t, each of which comprises a head 1, a crossbar 3 and a filament 2 connecting together the head 1 and the crossbar 3. Each adjacent crossbars 3 are connected to each other through a connecting element 4 of a film or thin sheet, and in the fastener assembly T, crossbars 3 are as a whole in the form of a sheet.

Each adjacent heads 1 may be either connected to each other or not, but in order to avoid possible tangling of heads, they should preferably be joined together in a manner as shown in FIG. 3: As shown, each of the two side faces of the head 1 is so formed as to protrude or bulge from edges towards a central portion so as to provide an apex 5, and adjacent heads 1 are mutually connected through their facing apeces 5 in a manner capable of being easily disconnected by cutting.

Figure 5:
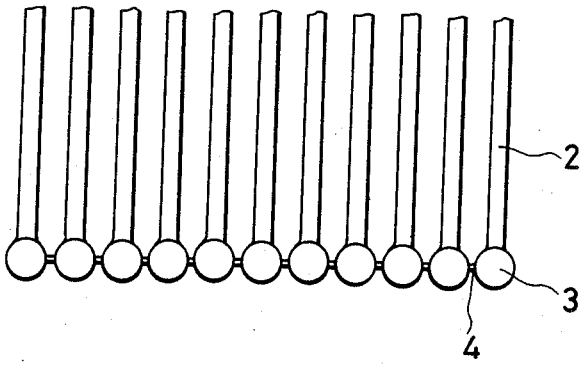
FIGS. 5, 6 and 7 are respectively a front elevation, a top plan and a side elevation, taken for illustration of the manner of connection to one another of crossbars in the fastener assembly of FIGS. 3 and 4.
Figure 6:
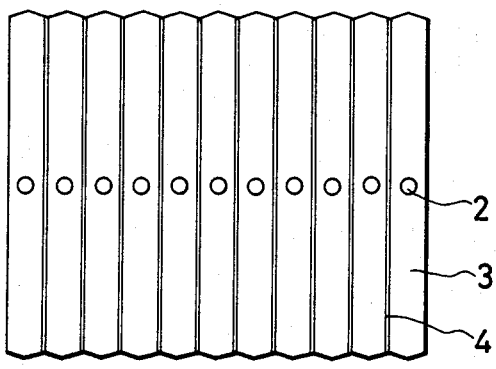
Figure 7:
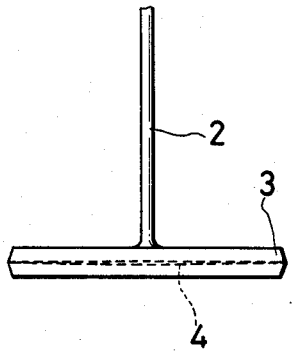

FIGS. 5, 6 and 7 are taken to illustrate crossbars 3 and their connecting elements 4, and as shown, while adjacent crossbars 3 are formed in an extremely close arrangement to each other (they are almost contacting with each other), they are connected through the connecting element 4, which is provided throughout the length of the crossbar 3 as shown in FIGS. 6 and 7. The elements 4 are formed in mold channels for molten synthetic resin for the molding of crossbars, and by positively (but not too strongly) connecting adjacent crossbars 3 together, exhibit the function of compactly forming the fastener assembly T.

In connection with connecting elements 4, a few important requirements should be answered, such as follows.

The elements 4 should not be liable to breakage during molding of the fastener assembly, and packing and transportation of product fastener assemblies, and yet can be easily cut upon shooting of fasteners by a fastener dispensing machine.

Also, they should have an enough strength to maintain crossbars 3 which they connect together, in the form of a sheet as a whole, and not to permit each adjacent crossbars 3 to change their positions relative to one another.

Moreover, they should be so small in width that when they are cut upon shooting of fasteners, their divided portions remaining on the sides of each crossbar are only of an extremely limited width, so that upon shooting the crossbar through an article, the latter would never be damaged.

Figure 8:
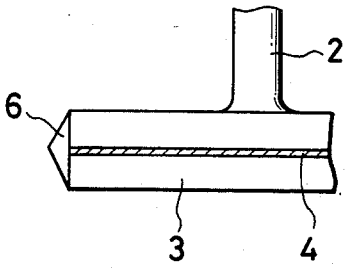
FIGS. 8 and 9 are sectional views, respectively showing a connecting element formed between adjacent crossbars in the fastener assembly according to the present invention.
Figure 9:
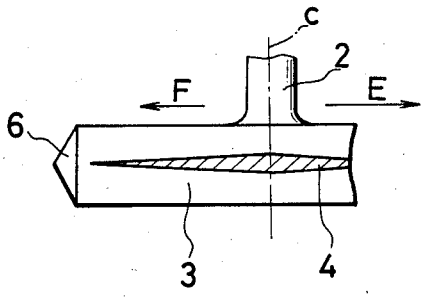

The longitudinal sectional shape of the connecting element 4 is not particularly limited in that it may be of a constant thickness in the longitudinal direction of the crossbar 3 and correspond to a section of a film of a constant thickness as shown in FIG. 8 or of varying thicknesses which are smallest at ends and gradually increasingly larger towards the center at which the element 4 crosses the center line C of the filament 2 as shown in FIG. 9.

However, it is limiting that the element 4 has a sufficient length for securely supporting its neighboring crossbars 3 in the form of a sheet: This is because if the element 4 is not formed substantially throughout the length of the crossbar 3 or its length is insufficient, crossbars 3 are prone to undergo a change in their relative positions.

In the case of connecting elements 4 having a flattened diamond shape in longitudinal crosssection as shown in FIG. 9, an advantage is realized such that upon completion of the molding, release of mold members can be facilitated in the directions of arrows E and F in FIG. 9, and this is highly advantageous particularly when fastener assemblies are manufactured at a high speed. A same advantage as above is realizable also where as an alternative of the flattened diamond shape illustrated in FIG. 9, the sectional shape of the element 4 may comprise a flattened triangle.

Figure 10:
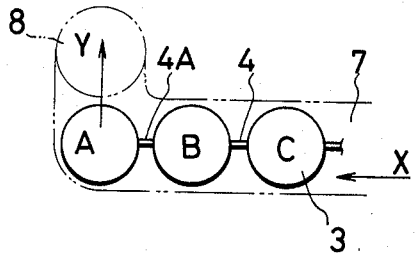
FIGS. 10 and 11 are top plan views, respectively showing a connecting element formed between adjacent crossbars according to the invention.
Figure 11:
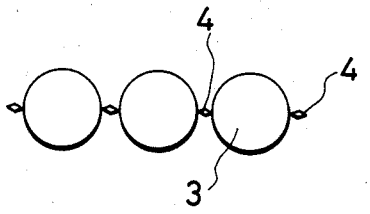

Further concerning the connecting element 4, it may comprise a thickness-constant thin film as shown in FIG. 10 or, more preferably, it should be so formed as to have thickness reduced ends at which it is connected to neighboring crossbars 3, when it is advantageously met that in the fastener dispensing operation with use of a fastener dispensing machine, the element 4 can be readily and completely removed away before each crossbar 3 is driven into a hollow needle mounted at the nose end of the fastener dispensing machine.

Although the length of the element 4 should most preferably be such as to substantially correspond to the full length of crossbar 3 as illustrated in FIGS. 7 and 8, a main or basic function assigned to the element 4 is to stably support two adjacent crossbars 3 so that their relative positions can be positively fixed and so that in the fastener assembly, the heads of member fasteners can be stabilized in position, therefore insofar as the element 4 can fully exhibit such function, its length is not specifically limited and may for example $\frac{1}{2}$, $\frac{1}{3}$, $\frac{2}{3}$, $\frac{3}{4}$ and so forth of the length of the crossbar 3. In this regard, the element 4 should extend in the longitudinal direction of the crossbars 3 to a point spaced from each side of the longitudinal center of said crossbars (near the intersection of the filament 2 and the crossbar 3), such points being at such distances from longitudinal center of the crossbars as are sufficient to maintain constant the relative position of the adjacent crossbars. In any event, essential are that connecting elements 4 serve to provide a more or less solid assembly of fasteners, that upon dispensing of fasteners they can with ease be cut and that they can be cut and removed as completely as possible.

As before stated, in the fastener assembly according to the present invention, a number of crossbars 3 are highly closely arranged to one another or even in a virtually contacting arrangement with one another, and they are positively but severably connected to one another through connecting elements 4, to the form of a sheet (as in the case of stapling needless to be dispensed by a stapler).

Reverting to FIGS. 8 and 9, the crossbar 3 is therein shown to have inclined end faces 6, which are formed so that a cutter blade mounted in the fastener dispensing machine for cutting at the connecting element 4 can be guided with an advanced ease into a small gap between adjacent crossbars 3.

In conventional fastener dispensing machines, which are often referred to also as guns, the crossbar 3 is cut just before it is driven into a hollow needle mounted at the front or nose end of the gun by a cutter blade such as a knife disposed in the vicinity of the rear end of the hollow needle.

In a relatively lately developed mechanism, cutting of crossbars takes place as follows. With reference to FIG. 10, which shows an operation condition in which a fastener assembly having crossbars A, B, C and so forth interconnected by elements 4 is fed in a guide groove 7 in a fastener dispensing gun in the direction shown by an arrow X and the first or the leftmost located crossbar A is about to be driven into a hollow needle 8, the crossbar A is then pushed up in the direction of an arrow Y to come to align in center with the opening of the hollow needle 8 by a piston operated by a lever of the dispensing gun. In the above, the crossbar A is forced in the direction of the arrow Y in the condition in which the succeeding crossbars B, C and so forth are held in position in the guide groove 7, so that the element 4A connecting the crossbar A to the next succeeding crossbar B becomes forcibly cut.

FIG. 12 represents a second embodiment of the invention, and in this embodiment, the crossbar indicated at **3*a* has a tapered configuration in plan view, which is broadest at the longitudinal center of the crossbar and gradually narrower towards ends thereof. Thus, the connecting element formed in the gap between each adjacent crossbars 3*a* and shown at 4*a* has an acute triangular configuration. If the connecting element 4A is made having an end face which is U shaped in plan view, by this the guidance of a cutter blade into the gap between adjacent crossbars 3*a* and the cutting of the element 4*a*** by the cutter blade can be greatly facilitated.

In the illustration of the second embodiment in FIG. 12, the tapering of crossbars **3*a* is depicted in exaggeration, and although the connecting element 4*a* is therefore seen to have a relatively broad area, in an actual fastener assembly this area should preferably be suppressed to minimum so that cut portions of the element 4*a* present on the sides of crossbar 3*a*** are substantially free of a detriment.

Figure 13:
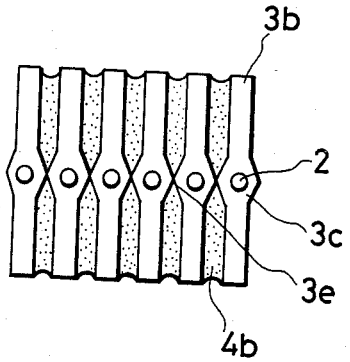
FIG. 13 is a top plan view similar to FIG. 12 and represents a third embodiment of the invention.

FIG. 13 illustrates a third embodiment of the invention, and the crossbar according to this embodiment, shown at **3*b* has an expanded portion 3*c* at a longitudinally central part thereof. Expanded portions 3*c* of neighboring crossbars 3*b* are in contact with each other or alternatively they are closely located to each other. If the connecting elements shown by 4*b* are of an extremely small thickness, likely is that fasteners can hardly be maintained in an assembled state as prescribed. In order to prevent such difficulty from occurring, in accord with the present embodiment crossbars 3*c* are formed with expanded portions 4*c*** and the latter are contacted with each other or closely arranged to each other to provide a strength or solidity as required of the fastener assembly.

FIG. 14 illustrates a fourth embodiment, in which adjacent crossbars 3 are interconnected by a pair of connecting elements **4*c* which comprise strap type members and are spaced from each other in the longitudinal direction of the crossbar 3**.

FIGS. 15 to 17 altogether represent a fifth embodiment, in which the crossbars 3 have different shapes in crosssection from the round ones of the foregoing described embodiments.

In the instance of FIG. 15, the crossbars indicated at 3A have an oval crosssection, and their ends 10 in the direction of their larger diameter are interconnected through elements 4. Then, with the embodiment of FIG. 16, each crossbar 3B is triangular in crosssection, and corners 11 on the bottom side of each adjacent crossbars are interconnected by connecting elements 4. Further, FIG. 17 shows crossbars 3C, each of which has a hexagonal shape in crosssection and which are interconnected at their corners 12 by connecting elements 4.

Common to the all three instances of the above described fifth embodiment of the invention, the width of connecting elements 4 is advantageously suppressed and, in addition, the elements 4 are now made able to be cut with an advanced ease by the cutting mechanism before described with reference to FIG. 10. Width of the element 4 being reduced, portions of the element which remain present on the sides of the crossbar when the element has been cut are advantageously reduced in width.

Further, the crosssectional shape of the crossbar may be other than those of the above described embodiments and may comprise for example a semicircular one or a more or less flattened semicylindrical one insofar as it is met essentially that connecting elements can exhibit a strength enough to positively interconnects the plurality of crossbars in the form of a sheet or thin plate as a whole and yet to be cut by a cutter blade without difficulty.

FIGS. 18 and 19 represent a further and a sixth embodiment of the invention, and in this embodiment, the connecting elements interconnecting crossbars 3, shown at 4B, comprise a rod type member in contrast to a film type member in the afore-described first embodiment. Also, the elements 4B of this embodiment is not so formed as to extend over the entire length of the crossbar 3.

The connecting element 4B comprising a rod type member, it now is more positively secured than otherwise that each adjacent crossbars 3 are prevented from changing their relative positions. Also, it being more rigid than for example a film member, the rod type element 4B can be cut away from the crossbar 3 with an increased ease and with an enhanced certainty, whereby it results in that there is substantially no cut portion of the element 4B remaining present on the sides of each crossbar 3 applied to an item of merchandise, so that the danger is cancelled of accidentally damaging merchandise, particularly those of a fine and soft texture such as clothing for example.

The connecting element 4B of the embodiment under consideration is of a more or less greater mass than the comparable elements in the other embodiments, and it certainly is disadvantageous in that the amount of material to be discarded as waste is unavoidably increased in comparison to the cases of a film type connecting elements. However, this rod type element 4B is more advantageous than disadvantageous in that the plurality of crossbars 3 in a fastener assembly can be stably maintained in the form of a sheet by the elements 4B, and also in that it comprising a rod, the element 4B can be separated from the crossbar 3 by cutting in an advantageous manner of producing no bur on the crossbar 3.

As described in detail above, the fastener assembly according to the present invention, which comprises a plurality of fasteners each comprising a crossbar, a filament connected to and extending from the crossbar, and a head formed at the opposite end of the filament relative to the crossbar, is characterized in that each adjacent crossbars are interconnected through a connecting element so that the plurality of crossbars in the fastener assembly are arranged in the form of a sheet as a whole and also in that the connecting elements are capable of being easily cut by a cutter blade.

Accordingly, the invention can bring about the following advantageous results.

(1) The fastener assembly can be devoid of connecting necks and a connecting rod which are unavoidable in conventional fastener assemblies for arranging a plurality of fasteners to a comb-like assembled form. Thus, according to the invention, it is feasible to curtail the use amount and the cost of a material synthetic resin.

(2) By the connecting elements, each adjacent crossbars are positively interconnected and can stably maintain their relative positions, so that it is effectively prevented from occurring that during manufacture of the fastener assembly and/or during transportation of product fastener assemblies, individual fasteners become separated from one another or that when the fastener assembly is permitted to touch merchandise during the fastener dispensing operation, the connection between adjacent crossbars is easily broken and fasteners become severed individually.

(3) With conventional fastener assemblies which have connecting necks and a connecting rod, it takes place that as more fasteners are dispensed by a fastener dispensing machine or gun, the connecting rod becomes increasingly projected below the gun, and it then is likely that the connecting rod or a cut portion of a connecting neck projected on the connecting rod catches at and damages an article such as a fabric-made article. Such a danger is completely cancelled with the fastener assembly of the present invention, which is devoid of the connecting rod and connecting necks.

(4) When heads of adjacent fasteners are interconnected as in the above described first embodiment of the invention (FIGS. 3 and 4), a great number of fasteners can be highly densely arranged to a compact assembly form. Such a fastener assembly is advantageous in that in the manufacture thereof, the flow of a molten synthetic resin takes place with an advanced ease and that the temperature control of the mold can be easily performed, whereby it is feasible to manufacture fastener assemblies precisely and at a high production efficiency.

(5) The fastener assembly being of such a compact arrangement of member fasteners as stated above, packing and transportation of a number of fastener assemblies can be facilitated.

We claim:

1. A fastener assembly wherein a plurality of closely adjacent fasteners individually comprise a head, a crossbar and a filament connecting said head and said crossbar together and altogether integrally molded from a synthetic resin in a manner such that while said head, said crossbar and said filament of each fastener is arranged in a same plane, said filament extends perpendicularly to said crossbar, the fasteners in use being loaded, assembly by assembly thereof, in a fastener dispensing machine having a hollow needle and each fastener individually successively appled through the hollow needle of the machine to attach for example tags or the like to merchandise, and wherein crossbars of adjacent fasteners are arranged in closely spaced and substantially directly contacting relation to each other, the invention characterized by crossbars of adjacent fasteners being connected together only by a connecting element integral with the crossbars and extending through the close space between adjacent crossbars and also extending in the longitudinal direction of the crossbar a distance to a point spaced from each side of a longitudinal center of said crossbar, said distance being sufficient to maintain constant the relative position of the adjacent crossbars, said connecting element extending perpendicularly to said filament and being on a line defining the shortest distance between the adjacent crossbars, said connecting element further being of a limited strength to be readily cut when the fasteners are dispensed by the fastener dispensing machine.

2. A fastener assembly as claimed in claim 1, wherein said connecting element is formed to extend over the entire length of said crossbar.

3. A fastener assembly as claimed in claim 1, wherein said connecting element is in the form of a film having a constant thickness in longitudinal section of the element.

4. A fastener assembly as claimed in claim 1, wherein said connecting element has a flattened diamond shape in longitudinal section.

5. A fastener assembly as claimed in claim 1, wherein said connecting element has a flattened triangular shape in longitudinal section.

6. A fastener assembly as claimed in claim 1, wherein said connecting element is in the form of a film in crosssection.

7. A fastener assembly as claimed in claim 1, wherein said connecting element has a crosssectional shape which is tapered at side ends at which the connecting element is connected to crossbars.

8. A fastener assembly as claimed in claim 1, wherein said crossbar has a tapered shape in plan view which is broadest at the longitudinal center of the crossbar and gradually narrower towards ehds thereof, each adjacent crossbars being interconnected by connecting element in the form of a film.

9. A fastener assembly as claimed in claim 1, wherein said crossbar has an expanded portion at a longitudinally central part thereof, each adjacent crossbars being interconnected by connecting element in the form of a film.

10. A fastener assembly as claimed in claim 1, wherein said crossbar is round in crosssection.

11. A fastener assembly as claimed in claim 1, wherein said crossbar is oval in crosssection.

12. A fastener assembly as claimed in claim 1, wherein said crossbar is triangular in crosssection.

13. A fastener assembly as claimed in claim 1, wherein said crossbar is hexagonal in crosssection.

* * * * *